US005779433A

United States Patent [19]

Bocchi

[11] Patent Number: 5,779,433

[45] Date of Patent: Jul. 14, 1998

[54] ROTARY SUCTION AND BLOWING MACHINE

[75] Inventor: Giuseppe Bocchi, Parma, Italy

[73] Assignee: ESAM S.P.A., Parma, Italy

[21] Appl. No.: 778,364

[22] Filed: Jan. 2, 1997

[30] Foreign Application Priority Data

Feb. 21, 1996 [EP] European Pat. Off. ..... 96830077

[51] Int. Cl.[6] ..... F04D 29/42

[52] U.S. Cl. ..... 415/55.1

[58] Field of Search ..... 415/55.1–55.6

[56] References Cited

FOREIGN PATENT DOCUMENTS

| | | | |
|---|---|---|---|
| 0351372 | 1/1990 | European Pat. Off. . | |
| 459269 | 12/1991 | European Pat. Off. . | |
| 567874 | 11/1993 | European Pat. Off. . | |
| 872819 | 4/1953 | Germany . | |
| 1956013 | 11/1969 | Germany . | |
| 2131952 | 1/1973 | Germany | 415/55.1 |
| 206795 | 2/1982 | Japan . | |
| 271992 | 11/1987 | Japan | 415/55.2 |

*Primary Examiner*—John T. Kwon
*Attorney, Agent, or Firm*—Browdy & Neimark

[57] ABSTRACT

The invention relates to an improved suction and blowing machine comprising an impeller provided with blades which rotate internally of an annular channel afforded in a body. The annular channel comprises a first tract having a transversal section which is greater than that of the blades, and is constituted by two communicating semichannels. The annular channel extends from an intake mouth to a delivery mouth and is provided with a peripheral wall facing external peripheral edges of the blades which peripheral wall bears a cusp-section projecting element extending over an entire length of the first tract of the peripheral wall and creates thereon two concave surfaces.

2 Claims, 2 Drawing Sheets

ROTARY SUCTION AND BLOWING MACHINE

BACKGROUND OF THE INVENTION

Reference is made in particular to a machine with lateral channel or air ring comprising an impeller provided with blades and closed in a body affording an annular conduit in which the impeller blades rotate. The annular conduit exhibits a suction mouth and a delivery mouth through which mouths a fluid can enter and exit the machine.

The annular conduit exhibits a first tract which, following the advancement direction of the blades in the conduit, extends from the intake mouth to the delivery mouth, and a second tract which goes from the delivery mouth to the intake mouth. The first tract has a transversal passage section which is greater than that of the second tract.

More precisely, each blade completely crosses the second tract, clearing the internal walls by only a very small distance; a distance which is preferably the smallest possible which is compatible, obviously, with degrees of friction permissible. A free space is left between the internal walls of the first tract and the blades, which free space is considerably greater and in which fluid turbulence can occur.

During functioning of the machine, the dynamic action of the blades generates a fluid current in the first tract of the annular conduit which is directed from the intake mouth towards the delivery mouth.

The conformation of the annular conduit, and in particular the presence of the abovementioned free space between the blades and the internal walls of the first tract of the annular conduit is necessary so that the motion of the blades causes an effective fluid current from the intake mouth to the delivery mouth.

The prior art teaches machines in which the first tract of the annular channel is divided into two symmetrical semichannels separated one from the other by radial walls arranged between one and a next blade, which generate a sort of dividing wall which in the first tract gives rise to a dragging seal on a corresponding dividing wall made at the peripheral surface of the same annular channel. Such realizations have the defect that the air flows generated in the two semichannels do not allow for the machine to self-balance.

In other realizations the blades rotate freely internally of the wide second channel without the presence of dividing walls physically dividing the annular channel into two semichannels, so that there is free communication between the two sides of the blade crown. A machine of this type is described in Italian patent IT 1225173 by the present applicant. In such a machine there is greater self-balance, due to the fact that the two flows of air generated in the two semichannels can freely interact.

SUMMARY OF THE INVENTION

The main aim of the present invention is to provide a machine of the same type as the one described above, which is however more productive. A further aim of the present invention is to realize a machine in which the self-balance is still further improved.

An advantage of the invention is that it achieves the above-mentioned aims while remaining constructionally simple and economic.

A further advantage is that the machine of the invention has a high performance both in terms of flow rate and head.

A still further advantage is the low generation of noise during operation.

These aims and advantages and others besides are all achieved by the machine of the invention, as it is characterized in the following claims.

BRIEF DESCRIPTION OF THE DRAWINGS

Further characteristics and advantages of the invention will better emerge from the detailed description that follows, of a preferred embodiment of the machine, illustrated in the accompanying drawings purely in the form of a non-limiting example, in which.

DESCRIPTION OF THE PREFERRED EMBODIMENTS

Figure 1:
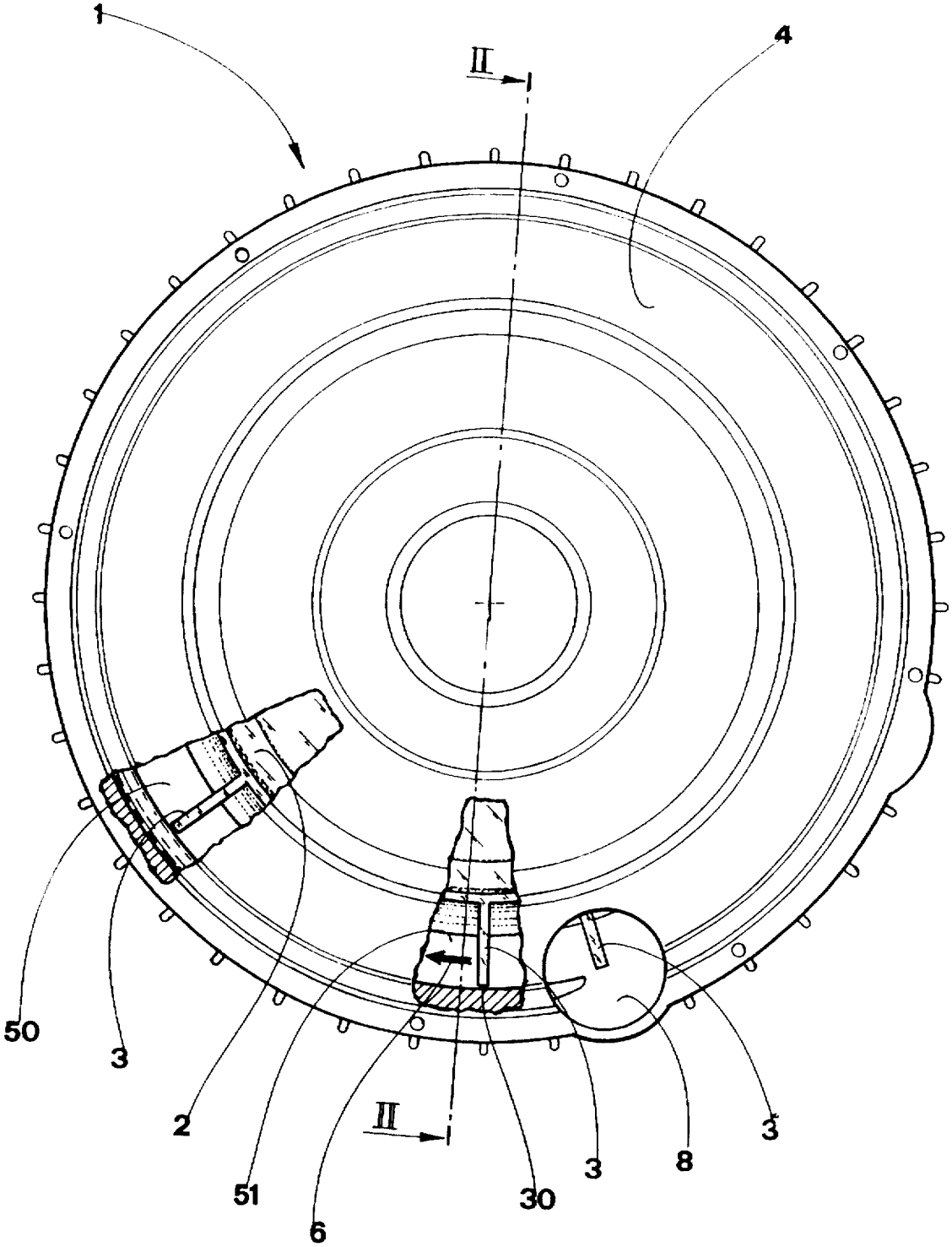
FIG. 1 is a vertical-elevation frontal view of the machine.

With reference to the figures, 1 denotes a rotary suction and blowing machine in its entirety.

The machine 1 is of the two-stage type, comprising two series-arranged single stage motors.

Each stage of the machine 1 comprises an impeller 2 provided with blades 3, the whole being closed inside a body 4 affording an annular conduit 5 internally of which the blades 3 of the impeller 2 rotate. The rotation direction of the blades 3 is indicated by an arrow 6.

The impeller 2 comprises a central hub 7 for connection with a rotating shaft, not illustrated, having a rotation axis indicated by x—x.

Each blade 3 exhibits a peripheral edge 30, parallel to the axis x—x, and two opposite lateral edges 31 which develop on planes which are normal to axis x—x.

Figure 2:
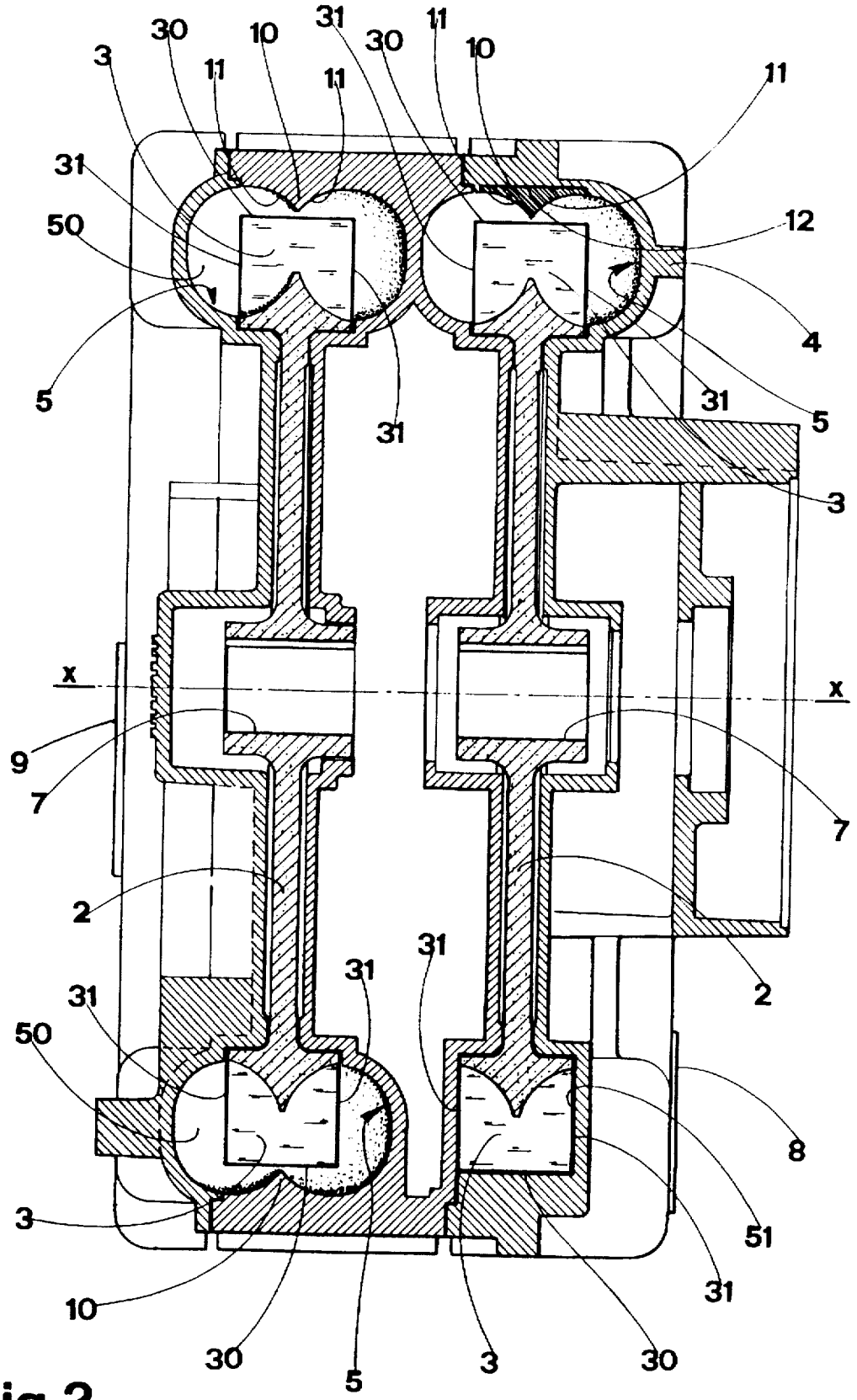
FIG. 2 is a section made according to line II—II of FIG. 1.

The annular conduit 5 comprises a first tract 50 at one end of which which an intake mouth 8 is situated, while at another end thereof is located a delivery mouth (not illustrated). In FIGS. 2, 8 denotes the intake mouth of the first stage and 9 the delivery mouth of the second stage. The transversal section of the first tract 50 of the annular conduit 5 is practically constant over its whole length.

The annular conduit 5 further comprises a second tract 51 which, with reference to the direction of motion of the blades in the annular conduit 5, extends from the delivery mouth 8 to the intake mouth (not illustrated).

The second tract 51 exhibits a transversal passage section (i.e., parallel to the rotation axis x—x) below that of the first tract 50 which is of rectangular outline, as shown in the drawing; further, the first tract 50 is considerably longer than the second tract 51.

The straight transversal passage section of the second tract 51 of the annular conduit 5 is, by shape and size, more or less the same or at most a little longer than the transversal section of the blade 3 crown, so that the peripheral edge 30 and the lateral edges 31 of each blade just breast the internal walls of the second tract 51 during rotation.

Contrarily, in the first tract 50 there is a free space between the internal walls of the annular conduit 5 and the peripheral and lateral edges of each blade 3. As is clearly visible in FIG. 2, the first tract 50 defines, parallel to the rotation axis x—x, the outer portion of an outline formed of two intersecting circles. The intersection-circle outline's two generally circular portions include the projecting element or portion 10 terminating in a point. The impeller 2 (exclusive of the blades 3) defines a complementary inner portion of the intersecting-circle outline. As seen in FIG. 2, the cross-hatched rim of the impeller 2 has a second projecting element terminating in a second point, which is radially separated from the first point by a gap.

This free space is necessary in order to obtain good aspirated or blown fluid head from the intake mouth 8 to the delivery mouth. In the first tract 50 therefore two communicating semichannels are generated, the presence of which permits the machine to self-balance to a considerable degree. All of the above refers to a single stage. A skilled person would intuit how two single machines would be connected in series to obtain the two-stage machine 1 illustrated in the accompanying figures. Briefly, the delivery of the first stage would be placed in communication with the intake of the second stage.

The characteristics described heretofore are common to the prior art and the present machine.

In the present invention, a projecting element 10 is associated to each stage of the machine 1, and is located solidly to a wall peripherally delimiting the first tract 50 of the annluar conduit 5, and is facing the peripheral walls 30 of the blades 3. This projecting element 10 projects internalwise of the first tract of annular conduit 5 and is shaped and arranged such as to define two concave surfaces 11 separated one from the other by the projecting element itself and extending mutually parallel along the entire length of the first tract 50 of the annular conduit 5.

The principal function of the projecting element 10 is to deflect the fluid, which is moved by the blades 3 turbulently in the first tract 50 of the annular conduit 5, such as to generate a situation in which a double vortex fluid flow is created which approximately follows the direction of the two concave surfaces 11.

This double vortex is superposed on the component of the fluid flow direction responsible for the formation of a fluid head, that is the component flowing along the axis of the annular conduit 5. The double vortex 5 caused by the presence of the projecting element 10 is responsible for the considerable improvement in performance noted at every stage of the machine 1 with respect to all other machines in the prior art.

The projecting element 10 preferably exhibits a transversal section in the shape of a cusp (as can be seen clearly in FIG. 2) with connected sides, and terminates in a point situated at a very short distance from the peripheral edges 30 of the blades 3. During the blades' 3 rotation, the edges 30 breast the point of the cusp. The projecting element 10 is preferably situated at the halfway point of the annular conduit 5.

The projecting element can be made in a single piece with the wall of the first tract 50 of the annular conduit 5 which is facing the peripheral edges of the blades 3. This is the case with the left stage in FIG. 2.

Alternatively the projecting element 10 can be made separately and fixed on to the wall. This is the case in the right stage illustrated in FIG. 2, where on the wall peripherally delimiting the first tract 50 of the annular conduit 5 and facing the peripheral edges 30 of the blades 3 there is an annular niche 12 housing the projecting element 10.

The second embodiment of the machine 1, with the projecting element 10 housed in the annular niche 12, is easily applicable also to known machines. The niche 12 could be sunk in the peripheral wall of the annular channel of a known machine and the projecting element 10 (separately made) inserted therein. The projecting element 10 might advantageously be made in two parts to ease its insertion into the niche 12, and might be fixed therein by friction force.

The projecting element 10 is conformed and arranged such that once inserted in the niche 12 its concave surfaces 11 are continuously disposed thereto, contributing considerably to the good functioning of the machine. Making a niche 12 contributes to obtaining smooth and continuous concave surfaces 11 in cases where the projecting element 10 is constructed separately and subsequently located on the conduit 5 wall.

In all illustrated embodiments the presence of the projecting element 10 contributes to accentuating the subdivision of the first channel tract 50 into two symmetrical semichannels having the important characteristic of being in mutual communication. This enables regular developing of the air flows which, thanks to the possibility of free interaction, allow for excellent self-balancing of the machine as well as obtaining high performance.

What is claimed:

1. A rotary suction and blowing machine comprising:

an impeller including substantially rectangular blades set parallel to a rotation axis of the impeller;

a body, in which the impeller is rotatably mounted for rotation about the axis thereof, having an annular conduit therein and a delivery mouth and an intake mouth each communicating with the annular conduit;

the annular conduit including a first tract and a second tract;

the second tract defining, parallel to the rotation axis, a rectangular outline;

the first tract further comprising two communicating semichannels and defining, parallel to the rotation axis, an outer portion of an intersecting-circle outline including two generally circular portions forming therebetween a projecting portion terminating in a first point;

the impeller, exclusive of the blades, defining parallel to the rotation axis a complementary inner portion of the intersecting-circle outline including a second projecting portion terminating in a second point;

the first point and the second point being separated by a gap.

2. The machine according to claim 1, wherein the point is situated at a half-way point of the first tract.

* * * * *